US006477847B1

(12) United States Patent
Bonaquist et al.

(10) Patent No.: US 6,477,847 B1
(45) Date of Patent: Nov. 12, 2002

(54) THERMO-SIPHON METHOD FOR PROVIDING REFRIGERATION TO A REFRIGERATION LOAD

(75) Inventors: Dante Patrick Bonaquist, Grand Island, NY (US); John Fredric Billingham, Getzville, NY (US); Jalal Zia, Grand Island, NY (US); Nancy Jean Lynch, No. Tonawanda, NY (US); Bayram Arman, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/107,787

(22) Filed: Mar. 28, 2002

(51) Int. Cl.[7] ..... F25D 17/02

(52) U.S. Cl. ..... 62/99; 62/119; 62/434; 165/104.21

(58) Field of Search ..... 62/99, 119, 434; 165/104.21

(56) References Cited

U.S. PATENT DOCUMENTS

| | | | | |
|---|---|---|---|---|
| 3,848,424 A | * | 11/1974 | Rhea | 62/119 |
| 3,953,971 A | * | 5/1976 | Parker | 62/119 |
| 4,986,077 A | | 1/1991 | Saho et al. | 62/51.1 |
| 5,744,959 A | | 4/1998 | Jeker et al. | 324/319 |
| 5,848,532 A | | 12/1998 | Gamble et al. | 62/48.2 |
| 5,966,944 A | | 10/1999 | Inoue et al. | 62/51.1 |
| 6,196,005 B1 | | 3/2001 | Stautner | 62/6 |
| 6,205,812 B1 | | 3/2001 | Acharya et al. | 62/607 |
| 6,336,331 B1 | | 1/2002 | White et al. | 62/48.2 |

* cited by examiner

*Primary Examiner*—Ronald Capossela
(74) *Attorney, Agent, or Firm*—Stanley Ktorides

(57) ABSTRACT

A method wherein refrigeration is generated, preferably using a pulse tube cryocooler or refrigerator, to produce cold working gas which is used to liquefy coupling fluid circulating between a coupling fluid liquid reservoir and a refrigeration load, such as superconductivity equipment, using thermo-siphon effects.

6 Claims, 5 Drawing Sheets

THERMO-SIPHON METHOD FOR PROVIDING REFRIGERATION TO A REFRIGERATION LOAD

TECHNICAL FIELD

This invention relates generally to the provision of refrigeration to a refrigeration load, and is particularly advantageous for providing refrigeration to superconducting equipment.

BACKGROUND ART

Superconducting equipment operates at very low temperatures, typically below 80K. Refrigeration must be provided to the superconducting equipment on a continuing basis in order to maintain the requisite very cold conditions for sustaining the superconductivity. Often the superconducting equipment is positioned at a remote location which puts a premium on the reliability of the refrigeration system which provides the refrigeration. Most refrigeration systems require the use of at least one cryogenic pump to deliver the refrigerant fluid to the refrigeration load. The use of refrigeration systems employing cryogenic pumps may be problematic when the refrigeration system is used to provide refrigeration to superconducting equipment.

Accordingly, it is an object of this invention to provide an improved system for providing refrigeration to a refrigeration load which has high reliability and which may be effectively employed to provide refrigeration to such applications as superconductivity applications.

SUMMARY OF THE INVENTION

The above and other objects, which will become apparent to those skilled in the art upon a reading of this disclosure, are attained by the present invention which is:

A method for providing refrigeration to a refrigeration load comprising:

(A) generating a cold working gas, warming the cold working gas by indirect heat exchange with coupling fluid vapor to produce coupling fluid liquid, and forming a coupling fluid liquid reservoir having a liquid level;

(B) passing coupling fluid liquid from the coupling fluid liquid reservoir to a refrigeration load using a thermo-siphon effect, said refrigeration load being at a lower elevation than the liquid level of the coupling fluid liquid of the coupling fluid liquid reservoir; and (C) providing refrigeration from the coupling fluid liquid to the refrigeration load and vaporizing the coupling fluid liquid to produce coupling fluid vapor for indirect heat exchange with cold working gas.

As used herein the term "thermo-siphon" means a process wherein a fluid is circulated in a device by providing heat which vaporizes some portion of the fluid which rises and is subsequently cooled and flows due to gravity back to the point where it can be vaporized again such that no mechanical device is used to move the fluid.

As used herein the term "regenerator" means a thermal device in the form of porous distributed mass, such as spheres, stacked screens, perforated metal sheets and the like, with good thermal capacity to cool incoming warm gas and warm returning cold gas via direct heat transfer with the porous distributed mass.

As used herein the term "pulse tube refrigerator" means a refrigerator device to produce low temperature refrigeration using suitable components including a pulse generator.

As used herein the term "orifice" means a gas flow restricting device placed between the warm end of the pulse tube expander and a reservoir in a pulse tube refrigerator.

As used herein the term "pressure wave" means energy which causes a mass of gas to go through sequentially high and low pressure levels in a cyclic manner.

DETAILED DESCRIPTION

Figure 1:
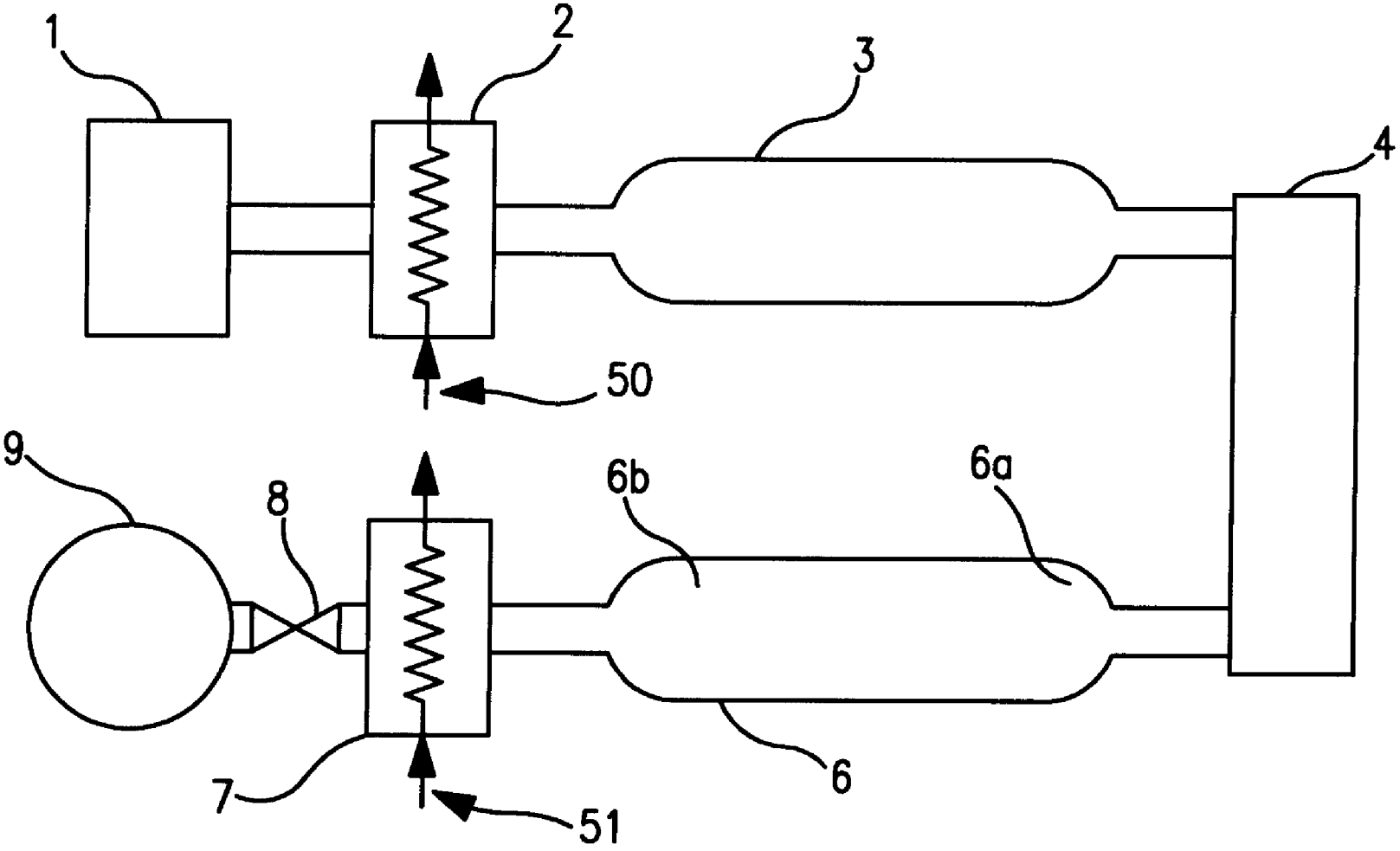
FIG. 1 is a simplified representation of one embodiment of a pulse tube refrigerator which may be used in the practice of this invention.

The invention comprises the use of a refrigeration cycle to generate a cold working gas to liquefy coupling fluid. Preferably the cold working gas is generated by the use of a pulse tube refrigerator, which has no moving parts beyond that required to generate the pressure wave, to generate refrigeration to produce the cold working gas to liquefy the coupling fluid. The liquefied coupling fluid is passed using the thermo-siphon effect to a refrigeration load thus eliminating the need for using a cryogenic pump. The arrangement increases the reliability of the system for delivering refrigeration, which is especially advantageous when the receiver of the refrigeration is at a remote location, such as is typical of superconductivity equipment.

The invention will be described in detail with reference to the Drawings and in conjunction with the preferred refrigeration system which employs a pulse tube refrigerator. The numerals in the Drawings are the same for the common elements.

The pulse tube refrigeration system is typically a closed refrigeration system that oscillates a working gas in a closed cycle and in so doing transfers a heat load from a cold section to a hot section. The frequency and phasing of the oscillations is determined by the configuration of the system. One embodiment of a pulse tube refrigerator or refrigeration system is illustrated in FIG. 1.

In the pulse tube refrigeration system illustrated in FIG. 1, driver or pressure wave generator 1 may be a piston or some other mechanical compression device, or an acoustic or thermoacoustic wave generation device, or any other suitable device for providing a pulse or compression wave to a working gas. That is, the pulse generator delivers acoustic energy to the working gas causing pressure and velocity oscillations. Helium is the preferred working gas; however any effective working gas may be used in a pulse tube refrigerator and among such one can name nitrogen, oxygen, argon and neon or mixtures containing one or more thereof such as air.

The oscillating working gas is cooled in aftercooler 2 by indirect heat exchange with cooling medium, such as water 50. Working gas in regenerator 3 is cooled by heat exchange with regenerator media as it moves toward the cold heat exchanger.

The geometry and pulsing configuration of the pulse tube refrigeration system is such that the oscillating working gas in the cold heat exchanger and the cold end 6*a* of the pulse tube 6 expand for some fraction of the pulsing cycle and heat is absorbed by the working gas by indirect heat exchange which provides refrigeration to said coupling fluid. Refrigeration from the working gas is passed by indirect heat exchange to the coupling fluid as will be more fully discussed below. Some acoustic energy is dissipated in the orifice and the resulting heat is removed from the warm end 6*b* typically by use of a warm heat exchanger 7 by indirect heat exchange with cooling medium, such as water 51. Preferably the pulse tube refrigeration system employs an orifice 8 and reservoir 9 to maintain the gas displacement and pressure pulses in appropriate phases. The size of reservoir 9 is sufficiently large so that essentially very little pressure oscillation occurs in it during the oscillating flow in the pulse tube.

Figure 2:
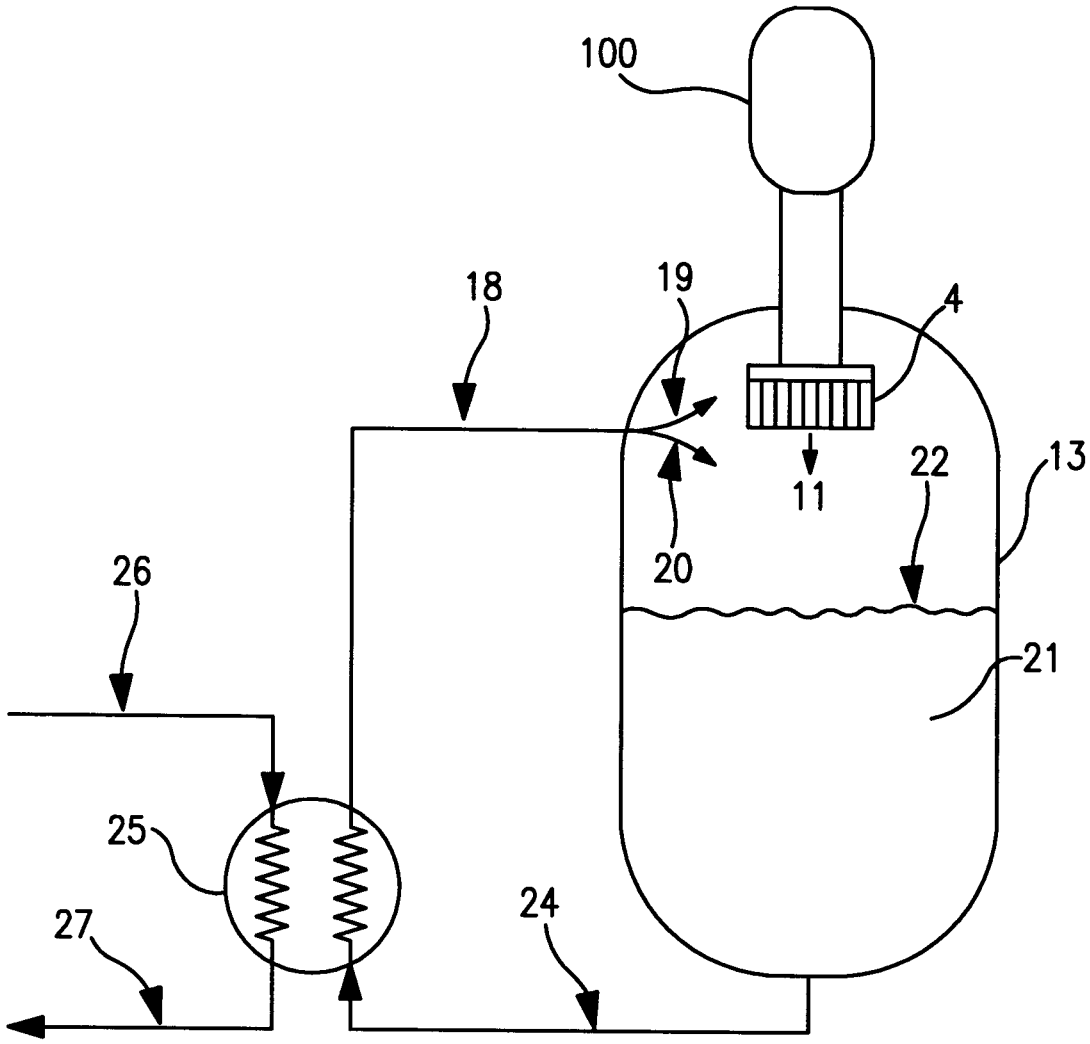
FIG. 2 is a schematic representation of one embodiment of the invention wherein the cold heat exchanger of the pulse tube refrigerator is located within the coupling fluid tank.

In FIG. 2 the pulse tube refrigerator, such as that described with reference to FIG. 1, is illustrated in general or block form as item 100 except for cold heat exchanger 4 which is specifically illustrated. Referring now to FIG. 2, coupling fluid 18, which may be all in vapor form or may be partly vapor and partly liquid, is passed into coupling fluid tank 13. In the embodiment of the invention illustrated in FIG. 2, coupling fluid 18 is in two phases. The liquid phase 20 falls down within coupling fluid tank 13 while the vapor phase 19 passes to cold heat exchanger 4 which is positioned within coupling fluid tank 13 in the upper portion of coupling fluid tank 13. The coupling fluid vapor 19 is condensed by indirect heat exchange with the aforedescribed cold working gas in cold heat exchanger 4 to produce coupling fluid liquid 11 which then passes out of cold heat exchanger 4 and, with coupling fluid liquid 20, forms coupling fluid liquid reservoir 21 within coupling fluid tank 13. The coupling fluid reservoir 21 has a liquid level 22, which is the top surface of the coupling fluid liquid, within coupling fluid tank 13.

The preferred coupling fluid in the practice of this invention is neon. Other fluids which may be used as the coupling fluid in the practice of this invention include helium, hydrogen, nitrogen, oxygen, argon, methane, krypton, xenon, R-14, R-23, R-218 and mixtures of one or more of those identified above such as air.

Coolant 26 is passed to refrigeration load device 25 which in the embodiment illustrated in FIG. 2 is a heat exchanger. The coolant 26 acts as the refrigeration load and is cooled by indirect heat exchange with coupling fluid liquid within heat exchanger 25. The resulting refrigerated coolant 27 is then used to provide refrigeration to, for example, a superconducting device. The coolant may be any fluid or mixture of fluids whose freezing point is simultaneously less than the desired operating temperature of the superconducting device and less than the boiling point or bubble point of the coupling fluid. This includes but is not limited to helium, hydrogen, neon, nitrogen, oxygen, argon, methane, krypton, xenon, R-14, R-23, R-218 and mixtures of one or more of the above such as air.

Coupling fluid liquid is passed in stream 24 from the coupling fluid liquid reservoir 21 within coupling fluid tank 13 to refrigeration load device 25 which is positioned at a lower elevation than coupling fluid liquid level 22. The coupling fluid liquid is at least partially vaporized by indirect heat exchange with the coolant in heat exchanger 25 thereby providing refrigeration to the coolant. The resulting coupling fluid vapor is passed in stream 18 back to cold heat exchanger 4 for liquefaction against cold working gas. As,mentioned above, stream 18 could also include coupling fluid liquid in addition to the coupling fluid vapor.

The coupling fluid passes from the coupling fluid tank to the refrigeration load device and back to the coupling fluid tank by the thermo-siphon effect thus eliminating the need for a cryogenic or other mechanical pump to process the coupling fluid although a pump may be used to augment the thermo-siphon effect when the density of the coupling fluid is very low or there are physical constraints imposed that hinder the circulation of the coupling fluid by the force of gravity. The levels and system pressure drops are designed such that heat exchanger 25 is neither flooded nor free of liquid. In some cases a control loop may be used. Liquid head, i.e. the height of liquid in tank 13, is maintained high enough to overcome the pressure in the lines and in heat exchanger 25.

Figure 3:
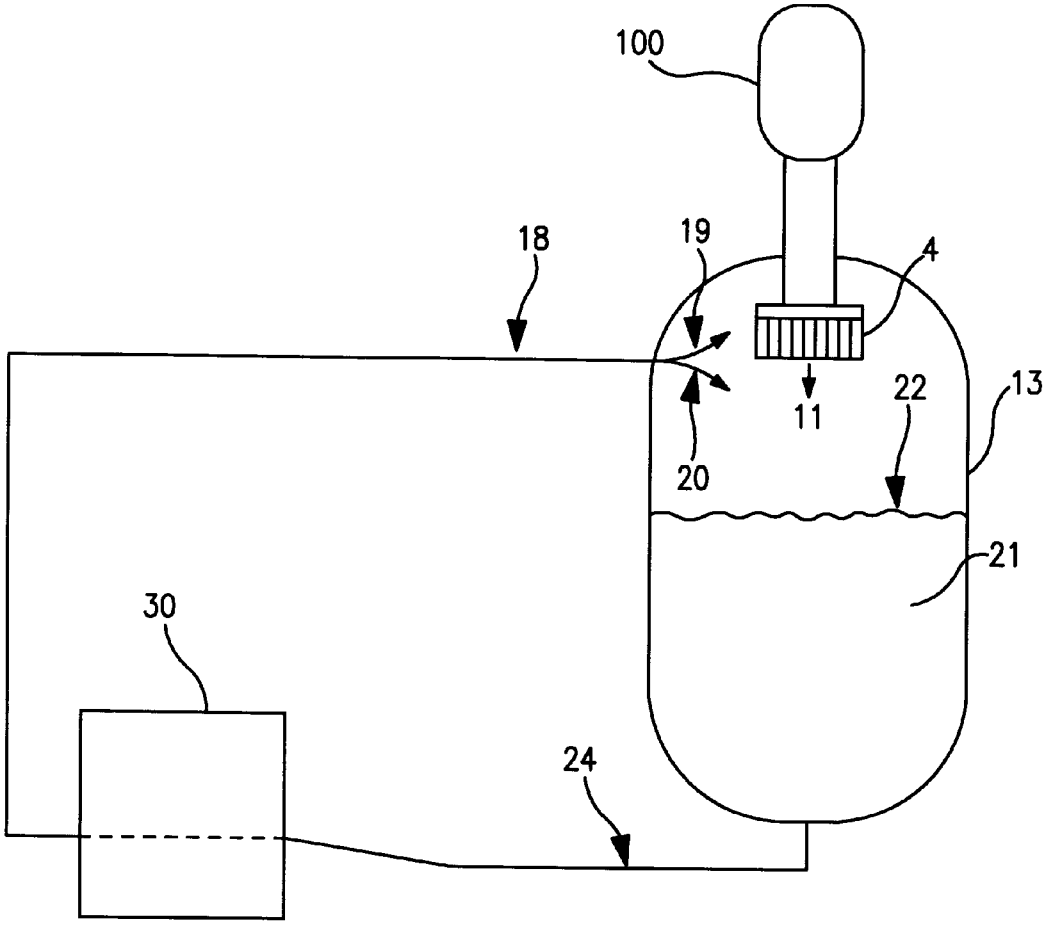
FIG. 3 is a schematic representation of one embodiment of the invention wherein refrigeration is provided directly by the coupling fluid to a superconducting device.

FIG. 3 illustrates another embodiment of the invention wherein the refrigeration load device is a superconducting device. The numerals of FIG. 3 are the same as those of FIG. 2 for the common elements, and these common elements will not be described again in detail.

Referring now to FIG. 3, coupling fluid liquid stream 24 is passed to superconducting device 30, which is positioned lower than the coupling fluid liquid level 22, and wherein it is at least partially vaporized thereby providing refrigeration to the refrigeration load. The resulting at least partially vaporized coupling fluid is passed in stream 18 from superconducting device 30 to cold heat exchanger 4 which, in the embodiment of the invention illustrated in FIG. 3, is located within coupling fluid tank 13. In general, the coupling fluid may be any fluid or mixture whose boiling point (bubble and dew points in the case of a mixture) is sufficiently below the desired outlet temperature of the coolant, or desired operating temperature of the superconducting device, when the pressure of the coupling fluid is maintained below critical pressure.

Figure 4:
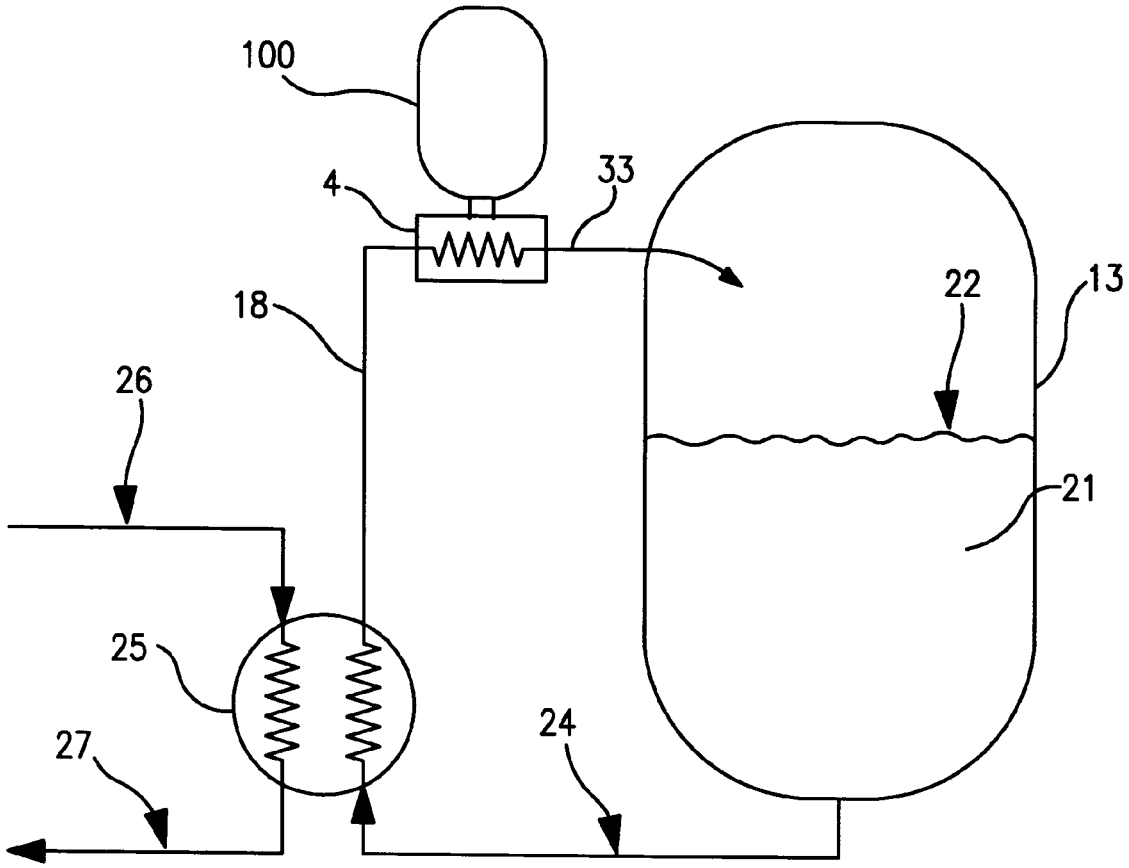
FIG. 4 is a schematic representation of one embodiment of the invention wherein the cold heat exchanger of the pulse tube refrigerator is located outside of the coupling fluid tank.

FIG. 4 illustrates another embodiment of the invention wherein the cold heat exchanger of the pulse tube refrigeration system is located outside of the coupling fluid tank. The numerals of FIG. 4 are the same as those of FIG. 2 for the common elements, and these common elements will not be described again in detail.

Referring now to FIG. 4, warmed coupling fluid 18 from heat exchanger 25, which may be totally or partially in vapor form, is passed to cold heat exchanger 4 of pulse tube refrigerator 100. The coupling fluid vapor is condensed by indirect heat exchange with cold working gas within cold heat exchanger 4, and the resulting coupling fluid liquid is passed in stream 33 from cold heat exchanger 4 to coupling fluid tank 13 wherein it forms coupling fluid liquid reservoir 21 having liquid level 22.

Figure 4A:
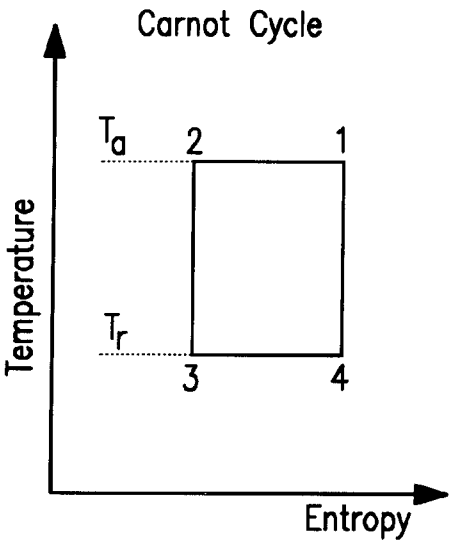
FIGS. 4A--4C are temperature/entropy diagrams for three different refrigeration cycles which may be used to generate cold working gas in the practice of this invention.
Figure 4B:
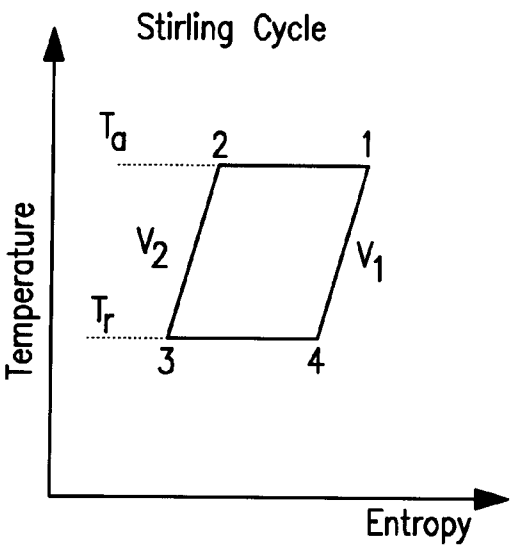
Figure 4C:
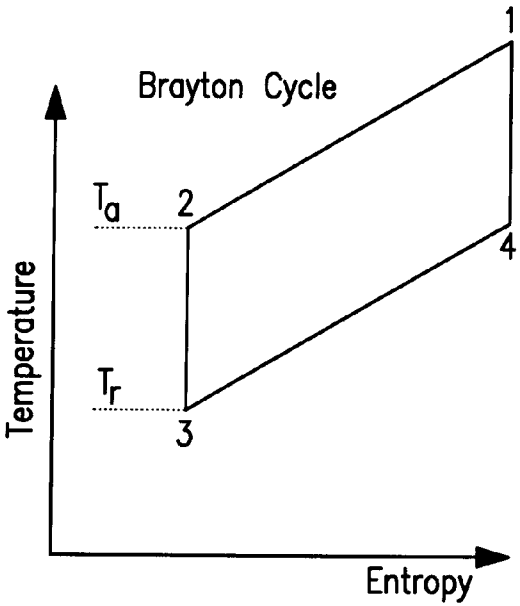

Preferably the pulse tube cryocooler or refrigerator is based on the Stirling cycle depicted in FIG. 4B. Alternatively, other thermodynamic refrigeration cycles can be employed. By way of example, some practical variations of the idealized Carnot and Brayton cycles, depicted in FIGS. 4A and 4C respectively, can be employed. In FIGS. 4A–4C "Tr" denotes the temperature where refrigeration is obtained. This is the lowest temperature for the ideal cycles. Other refrigeration cycles that can be employed in the cryocooler include magnetic refrigeration employing magnetocaloric materials operating under magnetic fields, and Joule-Thomson refrigeration. Other useful cryocooler cycles include variations of a Stirling cycle such as a Gifford-McMahon cycle, and an MGR (mixed gas refrigeration) cycle based on the Rankine cycle. The MGR cycle involves a refrigerant made up of different gas mixtures that is compressed by a common compressor, cooled by a set of precooling heat exchangers, and expanded via a Joule-Thomson isenthalpic expansion. Furthermore the cryocooler could be precooled using cold refrigerant or by another refrigerator. For instance, the pulse tube refrigerator could be precooled using liquid nitrogen refrigeration or by other refrigeration such as SGR (single gas refrigeration) or an MGR Rankine type refrigerator.

Now by the use of this invention one can generate refrigeration and deliver that refrigeration to a refrigeration load such as a superconducting device with few or no moving parts and without the need for a mechanical pump, thereby increasing reliability and thus effectiveness. Although the invention has been described in detail with reference to certain preferred embodiments, those skilled in the art will recognize that there are other embodiments of the invention within the spirit and the scope of the claims.

What is claimed is:

1. A method for providing refrigeration to a refrigeration load comprising:

(A) generating a cold working gas, warming the cold working gas by indirect heat exchange with coupling fluid vapor to produce coupling fluid liquid, and forming a coupling fluid liquid reservoir having a liquid level;

(B) passing coupling fluid liquid from the coupling fluid liquid reservoir to a refrigeration load using a thermosiphon effect, said refrigeration load being at a lower elevation than the liquid level of the coupling fluid liquid of the coupling fluid liquid reservoir; and (C) providing refrigeration from the coupling fluid liquid to the refrigeration load and vaporizing the coupling fluid liquid to produce coupling fluid vapor for indirect heat exchange with cold working gas.

2. The method of claim 1 wherein the coupling fluid comprises neon.

3. The method of claim 1 wherein the coupling fluid is passed from the coupling fluid liquid reservoir to the refrigeration load and thereafter is passed from the refrigeration load back to the coupling fluid liquid reservoir entirely by means of the thermosiphon effect.

4. The method of claim 1 wherein the refrigeration load comprises coolant fluid.

5. The method of claim 1 wherein the refrigeration load comprises superconductivity equipment.

6. The method of claim 1 wherein the cold working gas is generated by providing a pulse to a working gas to produce compressed working gas, and expanding the compressed working gas in a cold section of a pulse tube.

* * * * *